United States Patent [19]

Nelson

[11] 3,986,282

[45] Oct. 19, 1976

[54] STEAM IRON

[75] Inventor: Thomas Francis Nelson, Stratford, Conn.

[73] Assignee: General Electric Company, Bridgeport, Conn.

[22] Filed: Apr. 28, 1975

[21] Appl. No.: 571,986

[52] U.S. Cl. ..... 38/77.83
[51] Int. Cl.[2] ..... D06F 75/06
[58] Field of Search..... 38/77.83, 77.9, 77.5

[56] References Cited

UNITED STATES PATENTS

| | | | |
|---|---|---|---|
| 2,773,321 | 12/1956 | Gomersoll | 38/77.83 |
| 2,782,537 | 2/1957 | Vera-Mege | 38/77.83 |
| 3,165,843 | 1/1965 | Willman | 38/77.83 |
| 3,703,777 | 11/1972 | Knapp | 38/77.83 |
| 3,889,406 | 6/1975 | Chivers | 38/77.83 |

*Primary Examiner*—Patrick D. Lawson
*Attorney, Agent, or Firm*—John F. Cullen; George R. Powers; Leonard J. Platt

[57] ABSTRACT

In a steam iron with a fill opening to an interior water tank above a heated soleplate with a steam generator and ports to direct steam through the soleplate, an improvement is provided for delivery of surge of steam by a generally slanted control/pump assembly from upper forward to lower rear and comprising a pump cylinder communicating through its top with the tank and through its bottom with the generator through a metering orifice. A piston slidable in the cylinder moves between an upper position against a valve seat at the cylinder top to seal the cylinder from the tank for dry ironing, through an intermediate position establishing fluid connection between the tank and generator for continuous steaming, and into a lower position interrupting the fluid connection and trapping fluid below the piston. A slidable control button on the forward iron handle moves and maintains the piston in a selected one of the above positions and the control is selectively operable to momentarily lower the piston to a bottom cylinder position to rapidly expel the trapped fluid into the generator for a surge of steam through the ports. The ports are preferably so oriented that the iron is operable as a steamer in the vertical position as well as a standard iron in the normal horizontal ironing position.

7 Claims, 3 Drawing Figures

STEAM IRON

BACKGROUND OF THE INVENTION

1. Field of the Invention:

The invention relates to a steam iron having an interior water tank above an electrically heated soleplate with a steam generator and ports to direct steam through the soleplate and is directed to an improvement for steam delivery through the soleplate ports either as normal steam or a sudden surge of steam whereby the iron can be used for dry, steam, or surge of steam ironing as well as operating in the vertical position at least as a surge steamer.

2. Description of the Prior Art:

With the advent of steam irons, it has become common to provide extra steam capacity generally by rapidly forcing an extra slug of water into the usual steam generating area, whether a separate generator or the main steam generator, and the steam is then fed directly into the main distribution system to exit the soleplate ports as an extra surge or extra capacity steam. These irons are generally operable either dry, steaming, or with an extra surge of steam as selected by the user. Thus, the expedient of providing an extra surge of steam on demand is well-known. A typical iron of this type is shown in U.S. Pat. No. 3,703,777. The extra surge irons are not operable in a vertical position whereby the iron could also be used as an additional appliance namely, a steamer, that may be held in one hand and aimed at a vertically hanging garment to either steam it in the regular manner and/or blast it with an extra surge of steam. Also, it is broadly known to provide the steam valve toward the rear of an iron. Further, the prior art does not permit operation of the iron dry and then switching to steam and then back to dry without first going through a surge which could be undesirable.

SUMMARY OF THE INVENTION

Briefly described, the invention is directed to a steam iron having a fill opening to a water tank above an electrically heated soleplate and having a steam generator and ports to direct steam through the soleplate. To this general arrangement, there is provided an improvement for delivery of at least surge steam in the vertical position by a slanted connecting arrangement and, preferably of steam in both horizontal and vertical iron positions comprising a pump cylinder disposed at the rear of the tank and in communication through its open cylinder top with the tank and through delivery means in its bottom with the generator through a metering orifice with the open cylinder top having a valve seat. The generator is disposed in the rear soleplate portion substantially vertically below the cylinder bottom and a piston is slidable in the cylinder between an upper position against the valve seat to seal the cylinder from the tank for dry ironing. The piston operates through an intermediate position that establishes a fluid connection between the tank and generator for continuous steaming and then into a lower position interrupting said connection and trapping fluid below the piston. There is provided a pump control in the form of actuating means on the upper forward handle portion for moving and maintaining the piston in a selected position. Further, the actuating or moving means is connected by a slanted arrangement to be selectively operable to momentarily lower the piston to a bottom cylinder position to rapidly force a volume of water comprising the trapped fluid into the generator for a surge of steam through the ports for surging and steaming in both horizontal and vertical iron positions. Thus, the main object is to provide a steam iron which operates dry, in a normal steaming mode, or a sudden surge of steam preferably in either horizontal or vertical positions and which can go from dry to steam position and back to dry position with no surge if desired.

DESCRIPTION OF THE PREFERRED EMBODIMENT

The invention will be described in connection with a steam iron of the non-spray type although it should be understood that conventional spray mechanisms as well as pressurized iron systems may be employed.

Figure 1:
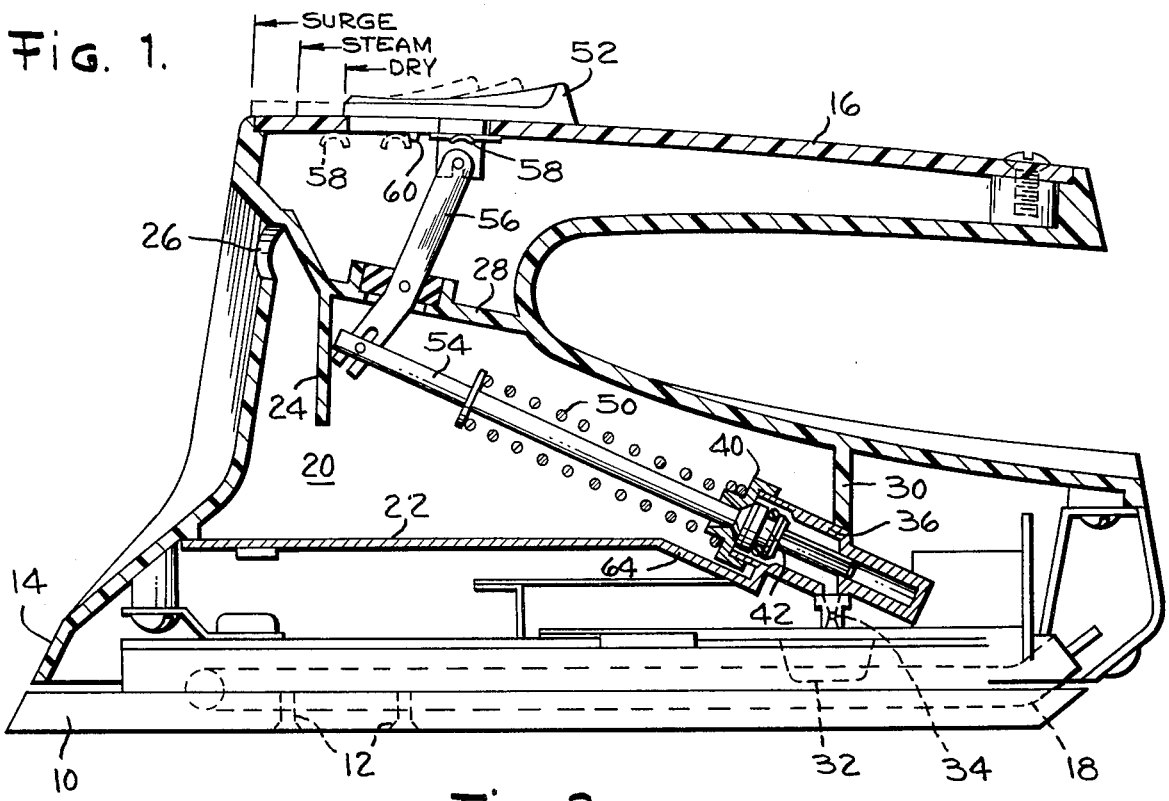
FIG. 1 is an elevational view, partially in section and phantom, showing general parts of a steam iron with the invention applied.

The invention discloses a steam iron which may be operated dry, steaming, and back to dry. It also includes means to provide a sudden surge of steam and, in the preferred form, all positions are operable in either the horizontal or vertical position so the iron may be used as a normal iron or as a handy steamer. Referring to FIG. 1, there is shown an electrical steam iron of the general type shown in U.S. Pat. No. 3,703,777 that includes a soleplate 10 having a plurality of steam ports 12 oriented in any suitable manner to direct steam through the soleplate and having an outer metal or plastic shell 14 suitably connected or integrally formed with closed or open handle 16 as shown. In accordance with conventional practice, soleplate 10 is made from material such as cast aluminum, with an electrical loop-shaped heating element 18 cast in position or, alternatively, the soleplate 10 may be a thin soleplate with heating element 18 welded thereto in the general form shown in U.S. Pat. No. 3,930,325 of common assignment and disclosing a wrought soleplate construction. The heating element 18 is controlled by a thermostatic means through a cord not shown in a well known manner.

The iron includes means for generating steam by providing water tank 20 directly above the electrically heated soleplate 10. The tank may be integrally formed of plastic as shown in FIG. 1 with a spaced bottom 22, baffle 24 protecting fill opening 26, and top and rear walls 28 and 30 respectively, completing the tank. For steam, a suitable steam generator generally shown at 32 is provided directly in the soleplate in the usual manner or above the soleplate as disclosed in the 3,930,325 patent with the generator feeding suitable well known distribution passages to exit through ports 12 in the soleplate. Steam is formed by delivering water from tank 20 through a metering orifice 34 as well known in flash steam irons.

Figure 2:
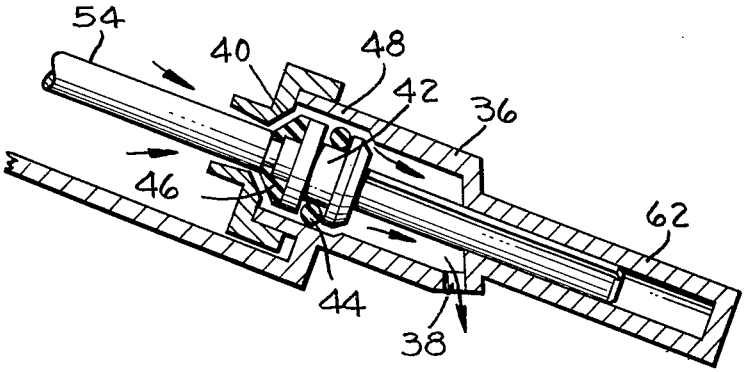
FIG. 2 is a partial sectional view of the pump in steaming position.

In accordance with the invention, an improvement is provided for delivery of steam in both horizontal and vertical iron positions while permitting the iron to operate from dry to steam and back to dry without going through a surge position which surge is available for an extra volume of steam when desired. It should be understood that the general "slanted" type arrangement disclosed i.e. from the upper forward control to the lower rear water delivery to the generator, will permit steam delivery in both horizontal and vertical positions in accordance with the main object of the invention. Thus, any suitable equivalent arrangement is contemplated and the embodiment described is a preferred illustration. To this end, there is provided a pump means in the form of cylinder 36 disposed at the lower rear of the tank 20 and with its inlet communicating through its open top with the tank for a water intake in either horizontal or vertical iron position as clearly shown in FIG. 2 and through its bottom at 38 via a delivery means in the form of metering orifice 34 with the steam generator 32 substantially vertically below the cylinder and in the rear soleplate portion of the iron. Preferably, a surge generator at the lower rear for both surge and steam, is provided although more than one generator, one for steam and one for surge, may be separately provided and such separate generators are known. The improvement provides at least surge in the vertical position and, as disclosed in the preferred form, it provides both regular steaming and surge in the vertical position. For dry ironing the cylinder is provided at its open top with a valve seat 40 which may be a screwed-on fitting as shown in FIG. 2. To control water distribution, a piston 42 with suitable sealing O-ring 44 is provided and which moves or slides in a reciprocating manner in the cylinder. The piston is also provided on its upper end with a seal 46 so that when the piston is in the upper position against valve seat 40 as in FIG. 1, the iron operates dry since no water from tank 20 can pass through cylinder 36 because the cylinder is sealed from the tank. For normal continuous steaming operation during the fluid connection, the cylinder is larger in cross section in its upper portion 48 to permit water to bypass or flow around the piston, through the cylinder and out bottom 38 to generator 32 to flash into steam. The piston is thus slidable through the intermediate position of FIG. 2, which establishes fluid connection between tank 20 and generator 32, for continuous steaming. The piston is freely movable between the dry position of FIG. 1 and steaming position of FIG. 2 in the usual manner of an iron not equipped with surging facilities. For "feel" the piston is normally biased by spring 50 towards the upper sealing or dry position of FIG. 1.

For actuation, it is convenient and preferred to have a slide control button 52 on the upper forward portion of handle 16, the button connecting with piston rod 54 through a generally slanted type connecting means such as a suitable pivoted lever 56 sealed through wall 28 to actuate the piston. As seen in FIG. 1, the solid lines show the slide button in the dry position where it is held by suitable flexible detent mechanism 58 and the bias of spring 50. For steam, push button 52 is slid to the left, out of the detent holding position and against the spring bias to the intermediate dotted steam position (FIG. 2) where detent 58 abuts a stop 60 as shown in the dotted center position in FIG. 1. Thus, a positive force giving "feel" to the user, is required to flex detent 58 to move the piston into the steaming position of FIG. 2 where it rests against stop 60. To return to dry position, button 52 is snapped to the right in FIG. 1 to ride over stop 60 back into the solid line dry position shown. Any suitable detent and slide mechanism or equivalent for moving and maintaining the piston in a selected position will suffice but it is important to be located in the upper forward handle portion to deliver water to the lower rear and that a positive "feel" be provided to tell the user what selected position the piston is in and hold it there. Of course, button 52 and the handle are suitably marked.

Figure 3:
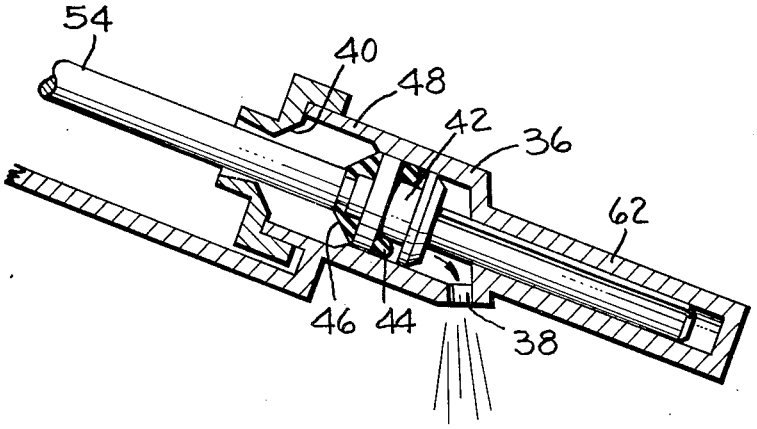
FIG. 3 is a similar view, showing the pump in surge position.

When an extra surge of steam is desired, such as for touch up, the piston is selectively operable to slide into a lower position to interrupt the fluid connection and trap fluid below the piston as shown in FIG. 3. This position is obtained by pushing button 52 all the way forward (to the left in FIG. 1) so it and the detent move to the far left dotted position shown whereupon the piston forces or expels the trapped water rapidly delivering it into the generator for a sudden surge of steam through the ports. Preferably, this position is a momentary position as the button is held forward against the bias of spring 50 for only a momentary surge. For smooth and positive operation, a suitable guide means 62 is disposed below the piston to hold it centrally in the cylinder and this may simply consist of an extension of the cylinder and piston rod as shown.

It will be apparent that the location of the pump means of the cylinder and generator in the lower rear portion of the iron as in FIG. 1, permits the iron through its slanted connection means from the upper forward portion, to operate equally well in a horizontal or vertical position since the water is dispensed from the low point in water tank 20 in either case. While not necessary, this may be enhanced by locating the piston assembly in a suitable offset or well 64 in the tank bottom 22 so that the iron may steam to a very low supply of water. Further, the arrangement of sealing in the up or left position of the piston as shown in FIG. 1 for dry operation, permits the iron to be operated from the FIG. 1 dry position to the FIG. 2 steaming position and then back to the dry position of FIG. 1 with no danger of surging whatever. Surging is obtainable only by forcing the piston to the extreme lower FIG. 3 position and is preferably a momentary action. With a suitable detent mechanism, a positive "feel" is given the user to go from dry to steam and back to dry without any intermediate surge which could be a disadvantage if the user, in a perfectly normal maneuver, were hand-straightening a wrinkled fabric and then desired to operate dry. With prior art surge irons of the type of patent 3,703,777, supra, this is not possible without an intermittent surge, no matter how brief, which could occur while the user's hand is below the iron straightening the fabric. The present invention permits return to normal dry operation with no intermediate surge whatever.

It will be seen that I have provided an iron that may be operated dry, steaming, and surge, in either horizontal or vertical position whereupon the iron is more flexible and may be used as a hand steamer for vertically hanging garments. Further, it is also operable either steaming or surging in the vertical position because of the lower rear location of the pump mechanism and the slanted connecting means between the forward upper control and lower rear delivery means. For vertical use, it may be desirable to orient the soleplate ports to provide more concentration in the nose for convenience. Additionally, the iron may be operated from dry to steam and directly back to dry again, which is the customary and preferred mode of operation, without any intermediate surge but still having full surge capabilities available as desired merely by pushing the slide control button 52 momentarily full forward whether the iron is in horizontal or vertical position.

While I have hereinbefore described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a steam iron with a handle and having a fill opening to a water tank above an electrically heated soleplate and having steam generating means and ports to direct steam through the soleplate, the improvement in providing for delivery of steam comprising, a steam generator positioned in the lower rear portion of the iron, pump means connected to said generator through a delivery means to rapidly force a volume of water to said generator for a surge of steam out said ports, pump control means on the upper forward portion of said handle, and means connecting said control means and the delivery means at said generator, said connecting means extending from said upper forward handle portion substantially slanted down to said delivery means for surge generation in the vertical position.

2. Apparatus as described in claim 1 wherein the pump intake is disposed to pick up water from said tank in either the horizontal or vertical position of said iron.

3. Apparatus as described in claim 2 wherein the pump delivery means is disposed vertically above said steam generator.

4. In a steam iron with a fill opening to a water tank above an electrically heated soleplate and having a steam generator and ports to direct steam through the soleplate, the improvement in providing for delivery of steam comprising, a pump cylinder in communication through its top with said tank and through its bottom with said generator through a metering orifice, piston means slidable in said cylinder, a valve seat at the cylinder top, said piston being movable between an upper position against said valve seat sealing the cylinder from the tank for dry ironing, through an intermediate position establishing fluid connection between the tank and generator for continuous steaming, into a lower position interrupting said connection and trapping fluid below said piston, means for moving and maintaining said piston in a selected position, said moving means being selectively operable to momentarily lower said piston to a bottom cylinder position to rapidly expel the trapped fluid into said generator for a surge of steam through said ports.

5. Apparatus as described in claim 4 wherein the cylinder is larger in cross section in its upper portion to permit a water bypass for said fluid connection when said piston is in intermediate position and, guide means below said piston guiding it centrally of said cylinder.

6. Apparatus as described in claim 4 having spring means biasing said piston toward upper sealing position against said valve seat for dry operation.

7. Apparatus as described in claim 5 having spring means biasing said piston toward upper sealing position against said valve seat for dry operation and the means for selectively positioning the piston is disposed on said handle.

* * * * *